US005935024A

United States Patent [19]

Lao

[11] Patent Number: 5,935,024

[45] Date of Patent: Aug. 10, 1999

[54] PING PONG REBOUND BOARD

[76] Inventor: John A. Lao, 536 N. Liberty St., Lebanon, Pa. 17042

[21] Appl. No.: 09/010,756

[22] Filed: Jan. 22, 1998

[51] Int. Cl.[6] ..... A63B 67/04

[52] U.S. Cl. ..... 473/434

[58] Field of Search ..... 473/475, 490, 473/491, 492, 493, 494, 495, 496, 113, 114, 115, 116

[56] References Cited

U.S. PATENT DOCUMENTS

| | | | |
|---|---|---|---|
| 3,001,790 | 9/1961 | Pratt | 473/434 |
| 3,697,068 | 10/1972 | McDougall | 473/434 |
| 4,134,585 | 1/1979 | Semon | 473/434 |
| 5,575,471 | 11/1996 | Robinson | 473/496 |

FOREIGN PATENT DOCUMENTS

| | | | |
|---|---|---|---|
| 2916262 | 10/1980 | Germany | 473/115 |
| 3246610 | 6/1984 | Germany | 473/113 |
| 25767 | of 1901 | United Kingdom | 473/113 |
| 1220057 | 1/1971 | United Kingdom | 473/115 |
| 84000497 | 2/1984 | WIPO | 473/115 |

*Primary Examiner*—Theatrice Brown

[57] ABSTRACT

A ping pong bounce back device is provided including a ping pong table and a back board mounted along one of the short parallel edges thereof. The back board has a front face with a plurality of undulations formed therein.

6 Claims, 2 Drawing Sheets

PING PONG REBOUND BOARD

BACKGROUND OF THE INVENTION

1. Field of the Invention

The present invention relates to ping pong tables and more particularly pertains to a new ping pong rebound board for practicing ping pong.

2. Description of the Prior Art

The use of ping pong tables is known in the prior art. More specifically, ping pong tables heretofore devised and utilized are known to consist basically of familiar, expected and obvious structural configurations, notwithstanding the myriad of designs encompassed by the crowded prior art which have been developed for the fulfillment of countless objectives and requirements.

Known prior art ping pong tables include U.S. Pat. No. 4,886,269; U.S. Pat. No. 4,772,018; U.S. Pat. No. Des 260,154; U.S. Pat. No. 4,089,522; and U.S. Pat. No. 3,942,795.

In these respects, the ping pong rebound board according to the present invention substantially departs from the conventional concepts and designs of the prior art, and in so doing provides an apparatus primarily developed for the purpose of practicing ping pong.

SUMMARY OF THE INVENTION

In view of the foregoing disadvantages inherent in the known types of ping pong tables now present in the prior art, the present invention provides a new ping pong rebound board construction wherein the same can be utilized for practicing ping pong.

The general purpose of the present invention, which will be described subsequently in greater detail, is to provide a new ping pong rebound board apparatus and method which has many of the advantages of the ping pong tables mentioned heretofore and many novel features that result in a new ping pong rebound board which is not anticipated, rendered obvious, suggested, or even implied by any of the prior art ping pong tables, either alone or in any combination thereof.

To attain this, the present invention generally comprises a ping pong table having a rectangular configuration with a planar horizontally oriented upper surface and a periphery. As shown in FIG. 1, the periphery is defined by a pair of long parallel edges and a pair of short parallel edges formed therebetween. The ping pong table further has a short rectangular net coupled in a vertical orientation between a central extent of each of the long parallel edges. As best shown in FIGS. 4 & 5, a pair of mounting brackets each include a lower portion defined by an elongated thin rectangular top and bottom strip. Integrally coupled along side edges of the top and bottom strip is an elongated thin rectangular side strip for defining an interior space and an open side face. The lower portion has a first end including a first bolt rotatably coupled through a vertically orientated threaded bore formed therein. A second end of the lower portion has an angled rear face and a cut out formed in the top strip. By this structure, the open side face of each lower portion may be situated about an associated one of the long parallel edges adjacent one of the short parallel edges of the ping pong table. In such orientation, the first bolt may be engaged with the ping pong table to secure the mounting brackets thereto. Each mounting bracket further includes an upper portion with a rectangular strip. A bottom end of the upper portion has a horizontally oriented threaded bore. An aperture is formed in the side strip of the lower portion adjacent the second end thereof for allowing a second bolt to be passed therethrough and further screwably coupled within the threaded bore. The upper portion further has a stopper stub integrally coupled to a rear face thereof and extending rearwardly therefrom. During use, the upper portions may be rotataby coupled about a common horizontal axis coincident with one of the short parallel edges of the ping pong table. Such upper portions may further be maintained in a desired orientation by way of the tightening of the second bolt. Finally, a back board is provided having a rectangular configuration with a planar rear face. Such rear face is equipped with two pairs of sleeves each defining a vertically oriented slot formed adjacent a side edge of the back board. As shown in FIG. 3, the sleeves function for releasably receiving the upper portions of the mounting brackets. FIGS. 1 & 2 shows that the back board further has a front face with a plurality of triangular cutouts formed therein between a top and bottom edge thereof. These cutouts define a plurality of abutting beveled surfaces for allowing a user to bounce a ping pong ball in various directions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ping pong rebound board apparatus and method which has many of the advantages of the ping pong tables mentioned heretofore and many novel features that result in a new ping pong rebound board which is not anticipated, rendered obvious, suggested, or even implied by any of the prior art ping pong tables, either alone or in any combination thereof.

It is another object of the present invention to provide a new ping pong rebound board which may be easily and efficiently manufactured and marketed.

It is a further object of the present invention to provide a new ping pong rebound board which is of a durable and reliable construction.

An even further object of the present invention is to provide a new ping pong rebound board which is susceptible of a low cost of manufacture with regard to both materials and labor, and which accordingly is then susceptible of low prices of sale to the consuming public, thereby making such ping pong rebound board economically available to the buying public.

Still yet another object of the present invention is to provide a new ping pong rebound board which provides in the apparatuses and methods of the prior art some of the advantages thereof, while simultaneously overcoming some of the disadvantages normally associated therewith.

Still another object of the present invention is to provide a new ping pong rebound board for practicing ping pong.

Even still another object of the present invention is to provide a new ping pong rebound board that includes a ping pong table and a back board mounted along one of the short parallel edges thereof. The back board has a front face with a plurality of undulations formed therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
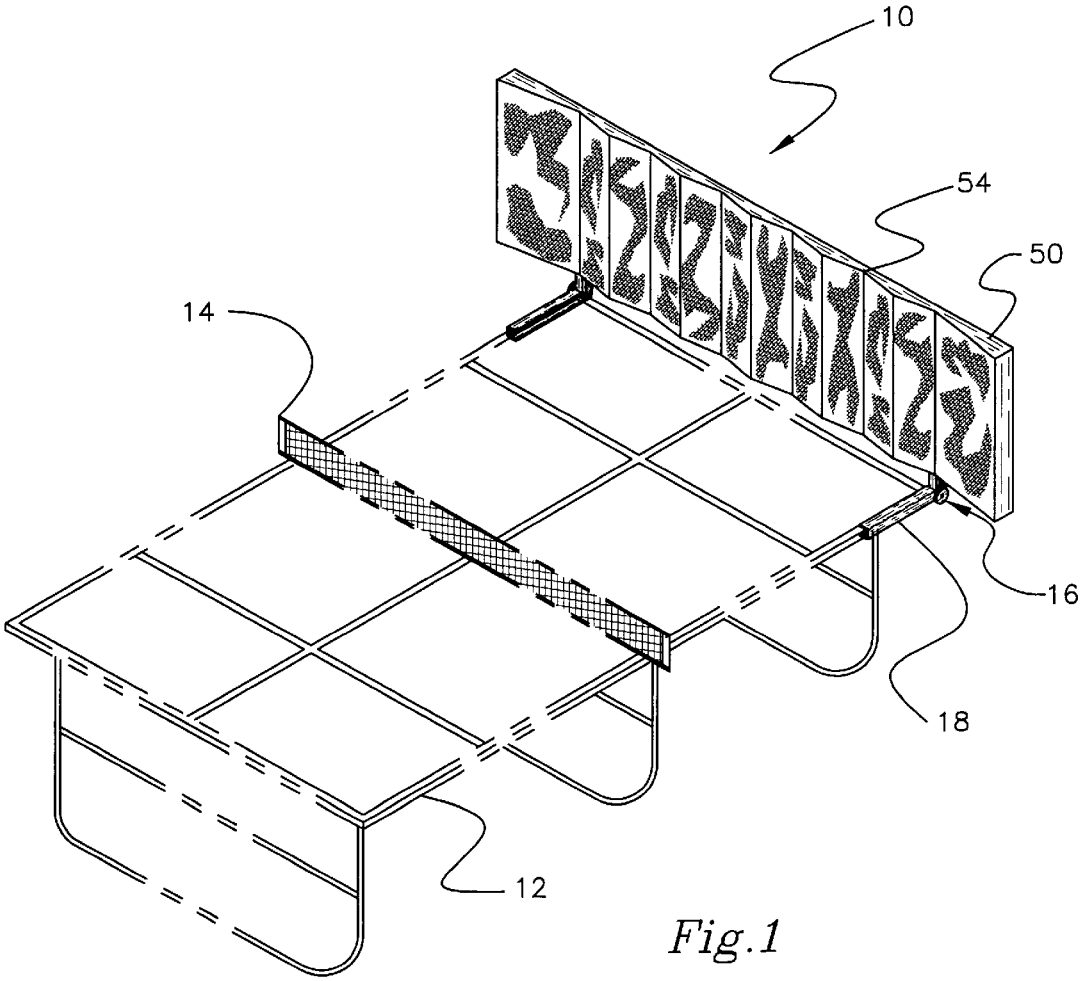
FIG. 1 is a perspective view of a new ping pong rebound board according to the present invention.

With reference now to the drawings, and in particular to FIGS. 1 through 5 thereof, a new ping pong rebound board embodying the principles and concepts of the present invention and generally designated by the reference numeral 10 will be described.

The present invention, as designated as numeral 10, includes a ping pong table 12 having a rectangular configuration with a planar horizontally oriented upper surface and a periphery. As shown in FIG. 1, the periphery is defined by a pair of long parallel edges and a pair of short parallel edges formed therebetween. The ping pong table further has a short rectangular net 14 coupled in a vertical orientation between a central extent of each of the long parallel edges.

Figure 4:
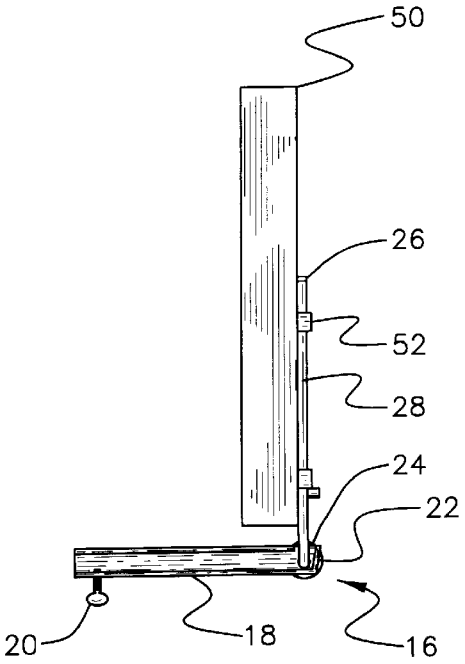
FIG. 4 is a side view of one of the brackets of the present invention.
Figure 5:
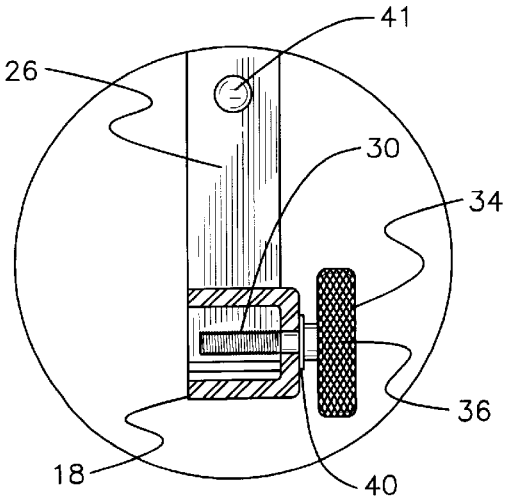
FIG. 5 is a front view of one of the brackets of the present invention.

As best shown in FIGS. 4 & 5, a pair of mounting brackets 16 each include a lower portion 18 defined by an elongated thin rectangular top and bottom strip. Integrally coupled along side edges of the top and bottom strip is an elongated thin rectangular side strip for defining an interior space and an open side face. A length of the lower portion is preferably about ¼ the length of the ping pong. The lower portion has a first end including a first bolt 20 rotatably coupled through a vertically orientated threaded bore formed therein. The first bolt has a tab for facilitating the tightening thereof.

A second end of the lower portion has an angled rear face 22 and a cut out 24 formed in the top strip. By this structure, the open side face of each lower portion may be situated about an associated one of the long parallel edges adjacent one of the short parallel edges of the ping pong table. In such orientation, the first bolt may be engaged with the ping pong table to secure the mounting brackets thereto.

Each mounting bracket further includes an upper portion 26 with a rectangular strip 28. A bottom end of the upper portion has a horizontally oriented threaded bore 30. A smooth aperture 32 is formed in the side strip of the lower portion adjacent the second end thereof for allowing a second bolt 34 to be passed therethrough and further screwably coupled within the threaded bore of the upper portion. The second bolt ideally has a knurled disk 36 coupled to an end thereof and further has a coaxial flange 40 coupled adjacent thereto. The upper portion further has a stopper stub 41 integrally coupled to a rear face thereof which extends rearwardly therefrom. The stopper stub is situated adjacent a bottom end of the upper portion.

During use, the upper portions may be rotataby coupled about a common horizontal axis coincident with one of the short parallel edges of the ping pong table. Such upper portions may further be maintained in a desired orientation by way of the tightening of the second bolt. It should be noted that the pivoting of the upper portions is constrained between an angle of 80–110 degrees by the rear face of the lower portion and a front edge of the cut out. As an option a motor assembly may be included to effect the automatic pivoting of the upper portions within the permitted range of movement for reasons that will become apparent.

Figure 2:
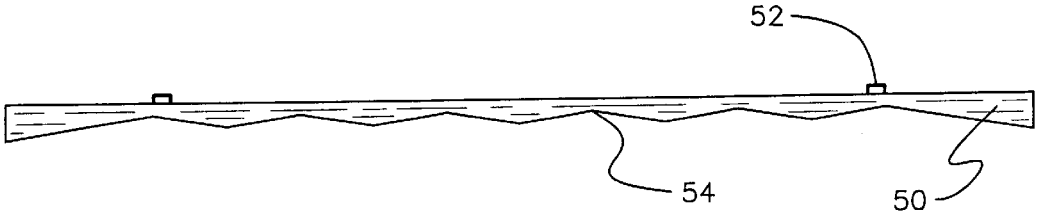
FIG. 2 is a top view of the present invention.
Figure 3:
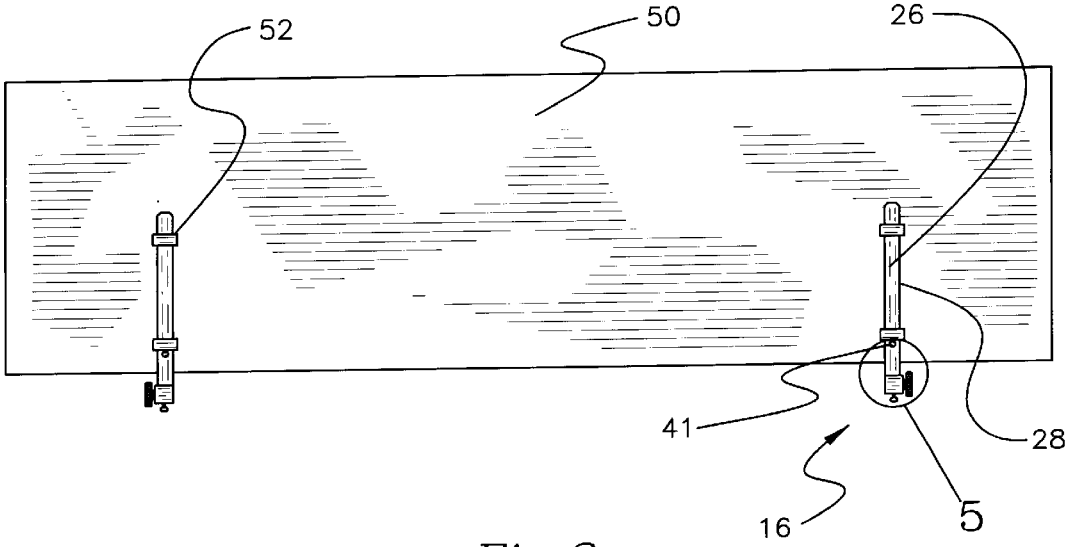
FIG. 3 is a rear view of the present invention.

Finally, a back board 50 is provided having a rectangular configuration with a planar rear face. Such rear face is equipped with two pairs of sleeves 52 each defining a vertically oriented slot formed adjacent a side edge of the back board. As shown in FIG. 3, the sleeves function for releasably receiving the upper portions of the mounting brackets. FIGS. 1 & 2 shows that the back board further has a front face with a plurality of triangular cutouts 54 formed therein between a top and bottom edge thereof. These cutouts define a plurality of abutting beveled surfaces for bouncing a ping pong ball in various directions. In the preferred embodiment, side ends of the back board extend past the long parallel edges of the ping pong table and further have a beveled surface which is of a lesser incline that associated with the remaining beveled surfaces.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ping pong bounce back device comprising, in combination:

a ping pong table having a rectangular configuration with a planar horizontally oriented upper surface and a periphery defined by a pair of long parallel edges and a pair of short parallel edges formed therebetween, the ping pong table further having a short rectangular net coupled in a vertical orientation between a central extent of each of the long parallel edges;

a pair of mounting brackets each including a lower portion defined by an elongated thin rectangular top and bottom strip with an elongated thin rectangular side strip integrally coupled along side edges of the top and bottom strip for defining an interior space and an open side face, the lower portion has a first end including a first bolt rotatably coupled through a vertically orientated threaded bore formed in the bottom strip and a second end having an angled rear face and a cut out formed in the top strip, whereby the open side face of each lower portion may be situated about an associated one of the long parallel edges adjacent one of the short parallel edges of the ping pong table and the first bolt may be engaged with the ping pong table to secure the mounting brackets thereto, each mounting bracket further including an upper portion including a rectangular strip having a bottom end having a horizontally oriented threaded bore for allowing the passage of a second bolt through an aperture formed in the side strip of the lower portion adjacent the second end thereof and further screwably coupled within the threaded bore, the upper portion further having a stopper stub integrally coupled to a rear face thereof and extending rearwardly therefrom, whereby the upper portions may be rotataby coupled about a common horizontal axis coincident with one of the short parallel edges of the ping pong table and further maintained in such orientation by way of the tightening of the second bolt;

a back board having a rectangular configuration with a planar rear face with two pairs of sleeves each defining a vertically oriented slot formed adjacent a side edge of the back board for releasably receiving the upper portions of the mounting brackets, the back board further having a front face with a plurality of triangular cutouts formed therein between a top and bottom edge thereof which define a plurality of abutting beveled surfaces for allowing a user to bounce a ping pong ball in various directions.

2. A ping pong bounce back device for use with a ping pong table having a rectangular configuration with a planar horizontally oriented upper surface and a periphery defined by a pair of long parallel edges and a pair of short parallel edges formed therebetween, the ping pong table further having a short rectangular net coupled in a vertical orientation between a central extent of each of the long parallel edges, the device comprising:

a back board with a substantially planar rectangular front face mounted along one of the short parallel side edges of the ping pong table, the back board further having a front face with a plurality of triangular cutouts formed therein between a top edge and a bottom edge thereof which define a plurality of vertically oriented abutting beveled surfaces for allowing a user to bounce a ping pong ball in various directions, wherein a pair of beveled surfaces of the back board are larger than the remaining beveled surfaces and face inwardly;

wherein the back board is pivotally mounted to the table;

wherein a length of the back board is greater than a width of the table.

3. A ping pong bounce back device as set forth in claim 2 wherein the back board is mounted to the ping pong table by way of at least one bracket which is removably coupled to the ping pong table.

4. A ping pong bounce back device as set forth in claim 3 wherein a pair of brackets are included for mounting to the long parallel edges of the ping pong table.

5. A ping pong bounce back device for use with a ping pong table having a rectangular configuration with a planar horizontally oriented upper surface and a periphery defined by a pair of long parallel edges and a pair of short parallel edges formed therebetween, the ping pong table further having a short rectangular net coupled in a vertical orientation between a central extent of each of the long parallel edges, the device comprising:

a pair of mounting brackets each including a lower portion adapted for being removably coupled to an associated one of the long parallel edges adjacent one of the short parallel edges of the ping pong table, each mounting bracket further including an upper portion including a strip having a bottom end pivotally coupled to the lower portion, whereby the upper portions may be rotatably coupled about a common horizontal axis coincident with one of the short parallel edges of the ping pong table and further selectively maintained in a desired orientation; and a back board having a pair of sleeves for releasably receiving the upper portions of the mounting brackets.

6. The ping pong bounce back device of claim 5 wherein the back board comprises generally parallel upper and lower edges and a front face extending vertically between the upper and lower edges, the front face being comprised of a plurality of deflecting surfaces adapted for deflecting objects impacting against the front face generally toward the long parallel edges of the ping pong table on which the back board is adapted to be mounted, the front face being entirely covered by the deflecting surfaces such that every object impacting against the front face is deflected toward one of the long parallel edges, the deflecting surfaces being divided from each other by divider lines oriented substantially perpendicular to the upper and lower edges, each of the deflecting surfaces being substantially rectangular in shape.

* * * * *